US005174940A

United States Patent [19]

Kumar et al.

[11] Patent Number: 5,174,940

[45] Date of Patent: Dec. 29, 1992

[54] METHOD OF EXTRUDING A SINGLE POLYMERIC FIBER

[75] Inventors: Satish Kumar, Duluth, Ga.; Marilyn Hunsaker, St. Paul, Minn.; Walter W. Adams; Thaddeus E. Helminiak, both of Dayton, Ohio

[73] Assignee: The United States of America as represented by the Secretary of the Air Force, Washington, D.C.

[21] Appl. No.: 671,988

[22] Filed: Mar. 14, 1991

Related U.S. Application Data

[63] Continuation-in-part of Ser. No. 456,009, Dec. 22, 1989, abandoned.

[51] Int. Cl.[5] ..... D01D 5/06

[52] U.S. Cl. ..... 264/184; 264/210.2; 264/210.8

[58] Field of Search ..... 264/103, 183, 184, 210.8, 264/339, 210.2, 178 R, 178 F; 57/310

[56] References Cited

U.S. PATENT DOCUMENTS

| | | | |
|---|---|---|---|
| 2,046,670 | 7/1936 | Beatty | 264/339 |
| 3,161,706 | 12/1964 | Peters, Jr. | 264/103 |
| 3,558,757 | 1/1971 | Denyes et al. | 264/103 |
| 4,019,311 | 4/1977 | Schippers | 264/103 |
| 4,263,245 | 4/1981 | Tan | 264/184 |
| 4,533,692 | 8/1985 | Wolfe et al. | 524/417 |
| 4,533,724 | 8/1985 | Wolfe et al. | 528/313 |
| 4,703,103 | 10/1987 | Wolfe et al. | 528/292 |

FOREIGN PATENT DOCUMENTS 57-193587 11/1982 Japan ..... 264/184

OTHER PUBLICATIONS

Satish Kumar-"Compressive Strength of High Performance Fibers" vol. 134, 1989, pp. 1-12.

Satish Kumar-"Uniaxial Compressive Strength of High Modulus Fibers for Composite", vol. 7, Mar. 1988, pp. 108-119.

Steven R. Allen-"Mechanical and Morphological Correlations in Poly(P-Phenylenebenzobisthiazole)", Jul. 1983, pp. 1-39.

Ordered Polymer Contract Research Review, Nov. 12-Nov. 15, 1985.

*Primary Examiner*—James Lowe

*Attorney, Agent, or Firm*—Fredric L. Sinder; Donald J. Singer

[57] ABSTRACT

A method and apparatus for making aromatic heterocyclic polymeric fibers having enhanced compressive strength are disclosed. Individual polymeric fibers, while being made according to otherwise conventional methods, are full twisted as they are drawn from a spinnerette hole so that their internal fibrils and microfibrils become entangled. The twisting is performed before coagulation of the fibers. The entangled fibrils and microfibrils are believed to provide mutual support to adjacent fibrils/microfibrils to resist buckling under compression.

1 Claim, 5 Drawing Sheets

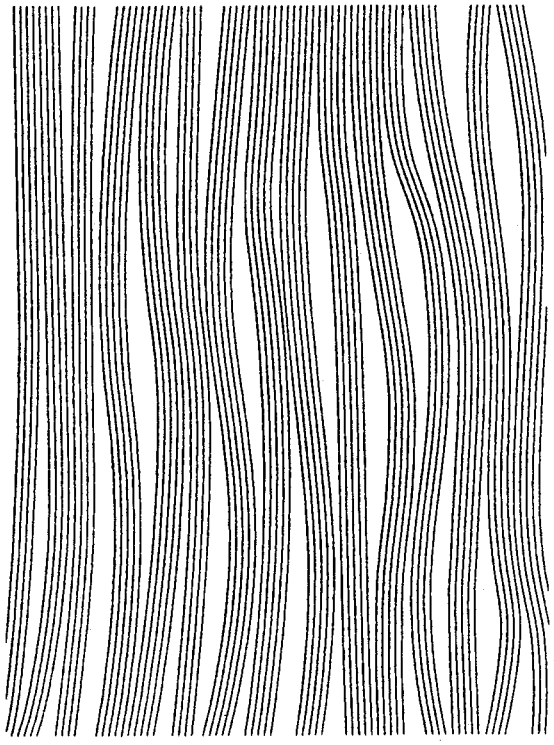
PRIOR ART *Fig. 2a*
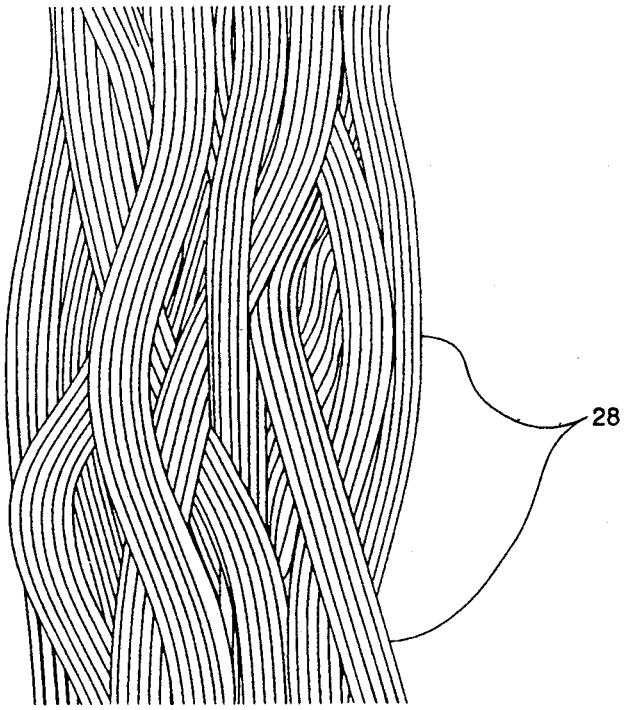
PRIOR ART *Fig. 2b*

METHOD OF EXTRUDING A SINGLE POLYMERIC FIBER

RIGHTS OF THE GOVERNMENT

The invention described herein may be manufactured and used by or for the Government of the United States for all governmental purposes without the payment of any royalty.

This application is a continuation-in-part of application Ser. No. 07/456,009, filed Dec. 22, 1989 and now abandoned.

BACKGROUND OF THE INVENTION

The present invention relates generally to high modulus/high strength fibers made from synthetic organic polymers, and more specifically to a method for making high modulus organic fibers having enhanced compressive strength.

High modulus, or high performance, polymeric fibers have increasingly been used to make high performance composites. Their very high strength-to-weight ratios makes them increasingly valuable, particularly for the aerospace industry.

Unfortunately, despite their very high tensile modulus and tensile strength, these high performance fibers are relatively weak in axial compression. This limits the compressive strength of composites made from them.

Aromatic heterocyclic polymeric fibers are made of even smaller fibers, called fibrils and microfibrils. One of the factors limiting the compressive strength of polymeric fibers is believed to be fibrillar and microfibrillar buckling under compression. Therefore, any reduction in fibrillar/microfibrillar buckling should result in fibers, and composites made from them, having enhanced compressive strength.

Proposed structural models in the prior art for existing carbon fibers having good physical properties in compression show a less highly ordered microfibrillar structure than in organic fibers. The microfibrils in the higher axial compressive strength carbon fibers appear to be entangled so that adjacent microfibrils support each other, thereby presumably reducing buckling and contributing to the desirable physical properties of the fibers in compression.

Thus it is seen that there is a need for a method for similarly entangling the fibrils and microfibrils of synthetic organic fibers to possibly improve their physical properties in compression.

It is, therefore, a principal object of the present invention to provide a method for making high performance polymeric fibers having an entangled microfibrillar morphology.

It is another Principal object of the present invention to provide a method for making high performance polymeric fibers having enhanced axial compressive strength.

It is an object of the present invention to provide a method for making high performance polymeric fibers having fibrils and microfibrils resistant to buckling.

It is a feature of the present invention that it is a straightforward and uncomplicated adaptation of current methods for making high performance polymeric fibers.

It is an advantage of the present invention that it makes possible the use of organic polymeric fibers, with their corresponding other advantages, in new high-performance composites that previously were not practical because of insufficient compressive strength.

These and other objects, features and advantages of the present invention will become apparent as the description of certain representative embodiments proceeds.

SUMMARY OF THE INVENTION

The present invention provides a method for markedly increasing the compressive strength of high modulus polymeric fibers. The unique discovery of the present invention is that entangling of the internal fibrils/microfibrils of individual polymeric fibers can be achieved by full twisting each individual fiber as it is drawn or formed and before coagulation occurs. The axial compressive strength of the thus processed fibers is thereby greatly enhanced.

Accordingly, the present invention is directed to a method for making a polymeric fiber, comprising the steps of providing a supply of polymer dope, drawing the dope through a hole, full twisting the dope as it is drawn from the hole, and coagulating the drawn and now twisted dope to form a fiber. The step of twisting the dope may be performed in an air gap and the step of coagulating the drawn and twisted dope may be performed in a water bath.

The present invention is also directed to an apparatus for making polymeric fibers having enhanced compressive strength, comprising means for extruding the dope through a hole, means for drawing the dope into a fiber as it is extruded, means for coagulating the drawn fiber and means for twisting the drawn fiber before coagulation. The means for twisting the drawn fiber may comprise twisting by hand. An air gap may be used into which the extruded dope is drawn and inside which the fiber is twisted. The air gap is positioned before the coagulating means. The coagulating means may comprise a water bath.

BRIEF DESCRIPTION OF THE DRAWINGS

The present invention will be more clearly understood from a reading of the following detailed description in conjunction with the accompanying drawings wherein:

FIG. 2*a* is a representative drawing of a highly oriented microfibrillar prior art proposed model for high modulus carbon fibers having lower compressive strength;

FIG. 2*b* is a representative drawing of a moderately oriented microfibrillar prior art proposed model for high modulus carbon fibers having higher compressive strength, showing some microfibrillar entanglement;

DETAILED DESCRIPTION

Figure 1:
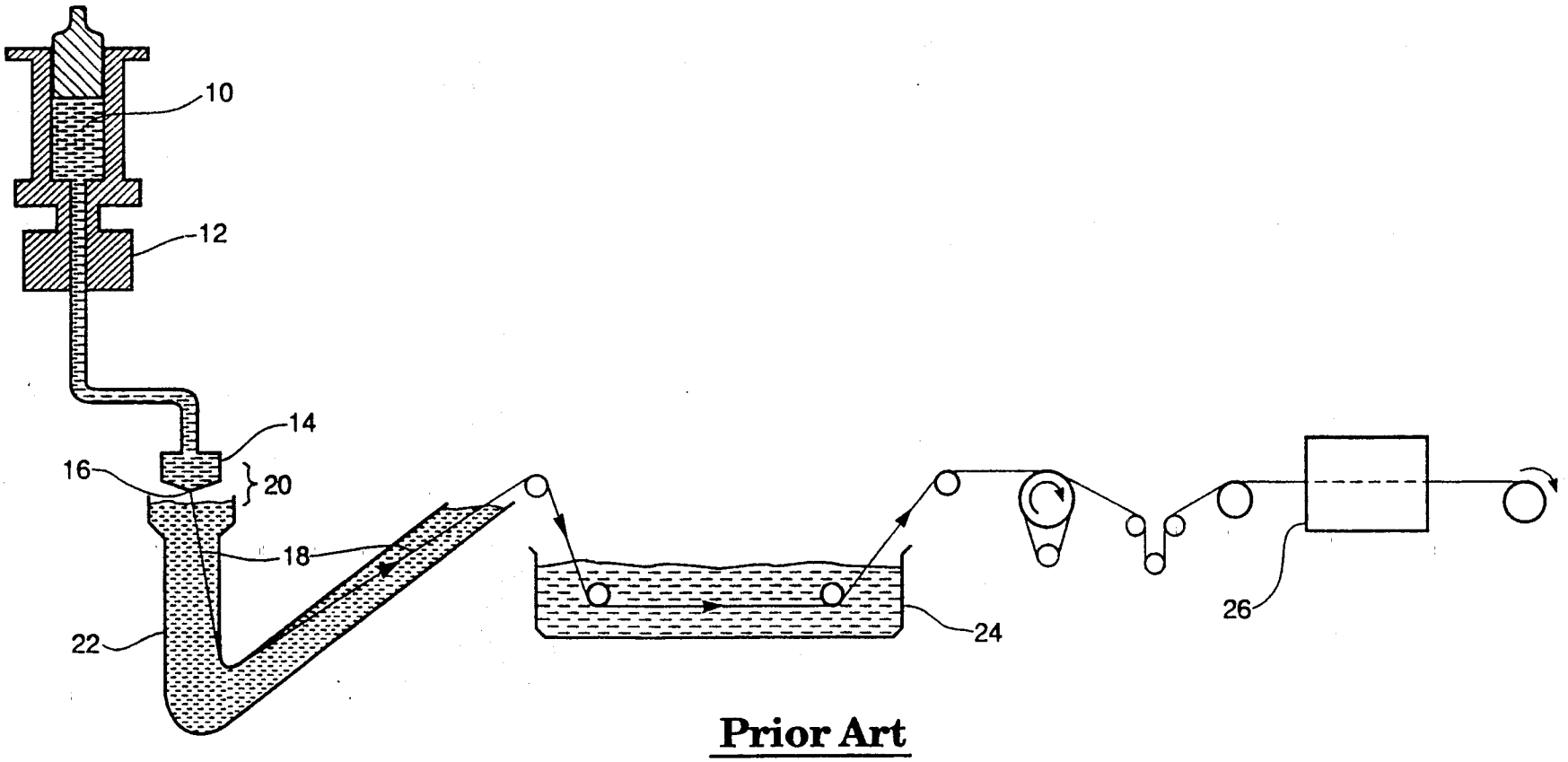
Prior Art Fig. 1
FIG. 1 is schematic diagram of a representative prior art dry jet wet spinning apparatus for making synthetic organic polymer fibers.

Referring now to FIG. 1 of the drawings, there is shown a schematic diagram of a representative prior art dry jet wet spinning apparatus for making synthetic organic polymer fibers. The term "spinning" derives from the traditional process for combining individual fibers of fibrous substances, such as cotton and wool, into thread or yarn. Unfortunately, the term is somewhat misleading when used to describe the process for making synthetic organic polymer fibers because, unlike traditional "spinning," the fibers are not twisted as they are formed. Once made, groups of individual fibers are often twisted together in a process more analogous to traditional "spinning" to form yarns or tows.

In a typical prior art use of the FIG. 1 apparatus, a synthetic polymer is dissolved into a strong acid solvent to form a liquid dope 10. Dope 10 generally also includes other ingredients as processing aids. Dope 10 is pressurized, generally in a pressurized vessel 12 called a bomb, and extruded through a hole die 14 called a spinnerette. Spinnerette 14 is a single hole, or extrusion orifice 16, die. Spinnerettes are generally multiple hole dies, sometimes referred to as spinneret packs. As dope 10 exits spinneret 14, the resulting fiber 18 is drawn, or stretched, at a rate greater than dope 10 is fed through spinnerette 14. This process stretches and aligns, or orients, the molecules in fiber 18 as it forms and is believed responsible for the favorable physical properties of the final fiber. The drawing process takes place in an air gap 20. Some solvent evaporates during this process and some coagulation initiates. After passing through the air gap, fiber 18 passes through a liquid coagulation bath 22, typically water, where most of the solvent is removed and coagulation of the filament is completed. Fiber 18 is generally assumed to achieve its final overall internal structure during this step.

As used in this detailed description and in the claims, the term "coagulation" is understood to refer to the coagulation process that occurs in a coagulation bath, or equivalent, and not to the coagulation initiation process that occurs in the air gap. The terms "fibrils," "microfibrils," "fibrillar" and "microfibrillar" are, except if specifically noted, used interchangeably. While the following described polymers are made from the class of aromatic heterocyclic extended chain polymers, the invention includes application to any polymers that may be processed by a dry jet wet spinning, or similar, process.

After leaving coagulation bath 22, fiber 18 passes through a wash bath 24 where any remaining solvent is removed. Finally, fiber 18 is pulled through a heat treating location 26. Fiber 18 is again stretched during heat treating. This appears to better organize the fiber 18 structure and develops the final physical properties of the fiber.

FIG. 2*a* is a representative drawing of a highly oriented microfibrillar prior art proposed model for high modulus carbon fibers FIG. 2*b* is a representative drawing of a moderately oriented microfibrillar prior art proposed model for high modulus carbon fibers showing some microfibrillar entanglement. The FIG. 2*a* model comes from study of x-ray scattering of high density carbon fibers, which exhibit low compressive strengths. The FIG. 2*b* model comes from study of electron microscope images and x-ray scattering of lower density carbon fibers, which exhibit much higher compressive strengths. The entangling of microfibrils 28 in FIG. 2*b* is believed to cause mutual support among adjacent microfibrils 28, thereby resisting buckling and resulting in higher compressive strengths.

Figure 3:
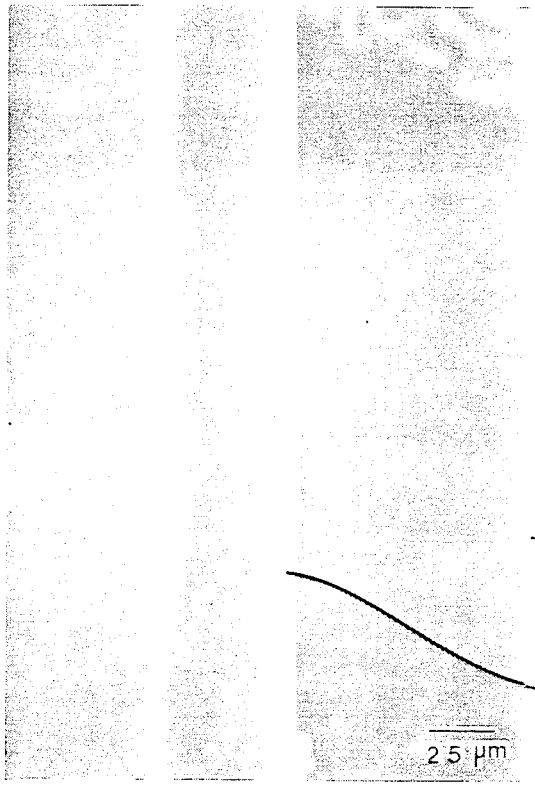
Fig. 3 PRIOR ART
FIG. 3 is a photomicrograph of a untwisted fiber made from PBO dope according to conventional prior art methods.

FIG. 3 is a photomicrograph of a single fiber 30 made from PBO dope (solution of polybenzoxazole in polyphosphoric acid) according to conventional prior art methods. Inspection shows the relatively well-ordered orientation of individual fibrils and microfibrils in fiber 30.

Figure 4:
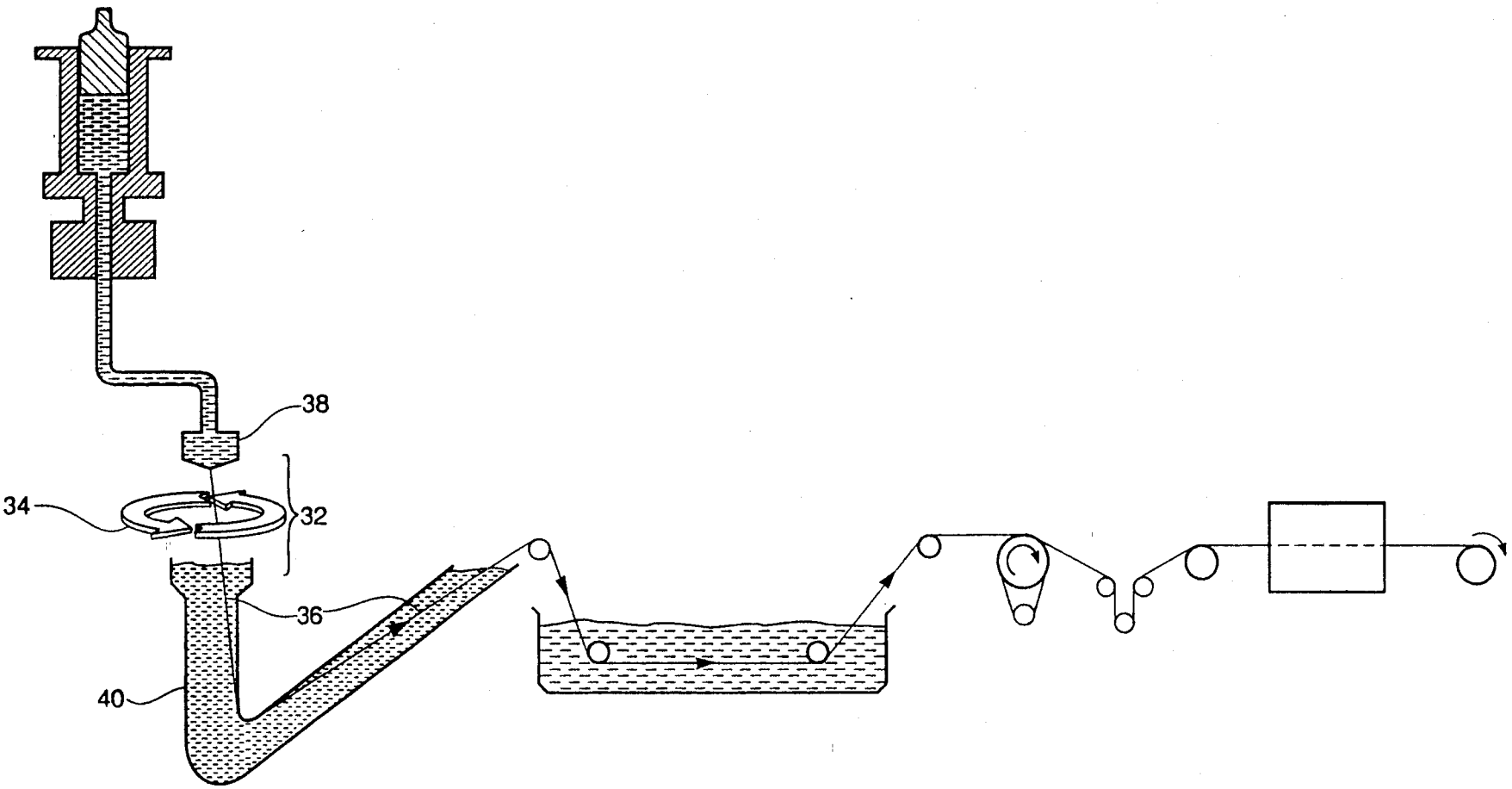
FIG. 4 is a schematic diagram of a representative dry jet wet spinning apparatus for making synthetic organic Polymer fibers according to the teachings of the present invention.

FIG. 4 is a schematic diagram of a representative dry jet wet spinning apparatus for making synthetic organic polymer fibers according to the teachings of the present invention. The FIG. 1 prior art dry jet wet spinning apparatus is modified by making a longer air gap 32 and adding a means 34 for full twisting the fiber 36 as it is drawn from a single hole spinnerette 38 and before it passes through a coagulation bath 40. Full twisting means at least a full 360° twist that occurs before any possible later twisting together of a plurality of individual fibers to make a tow.

Figure 5:
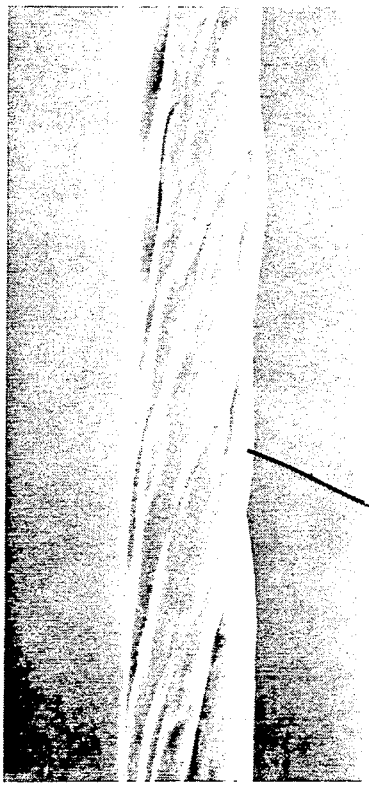
FIG. 5 is a photomicrograph of a twisted fiber made from PBO dope according to the teachings of the present invention.

FIG. 5 is a photomicrograph of a single PBO fiber 42 made by full twisting the fiber with twisting means 34 as it was drawn through air gap 32 and before it passed through coagulation bath 40. As seen in FIG. 5, the twisting has entangled the fibrils and microfibrils so that they now provide mutual support.

Figure 6A:
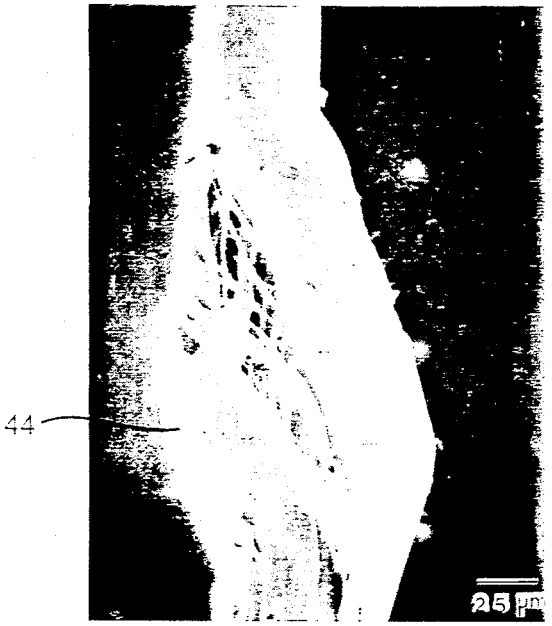
FIG. 6*a* is a photograph of a scanning electron microscope image of a slightly twisted PBO fiber, made according to the teachings of the present invention, showing the effects of a recoil test compression failure of the fiber.
Figure 6B:
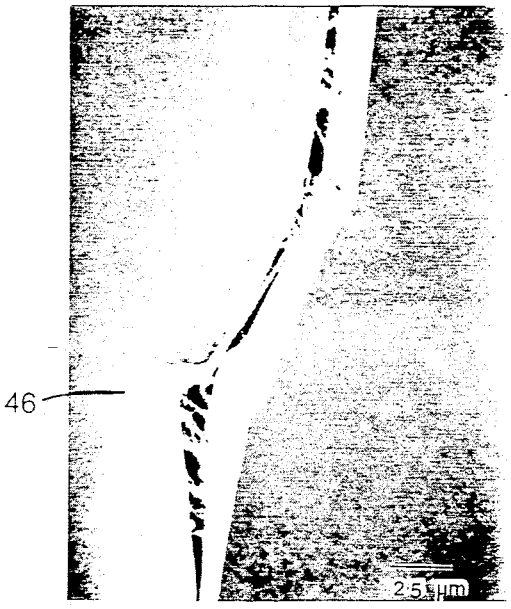
FIG. 6*b* is a photograph of a scanning electron microscope image of another slightly twisted PBO fiber made according to the teachings of the present invention, showing the effects of a recoil test compression failure of the fiber; and, FIG. 6*c* is a photograph of a scanning electron microscope image of a more highly twisted PBO fiber made according to the teachings of the present invention, showing the lack of failure after a recoil compression test of the fiber.
Figure 6C:
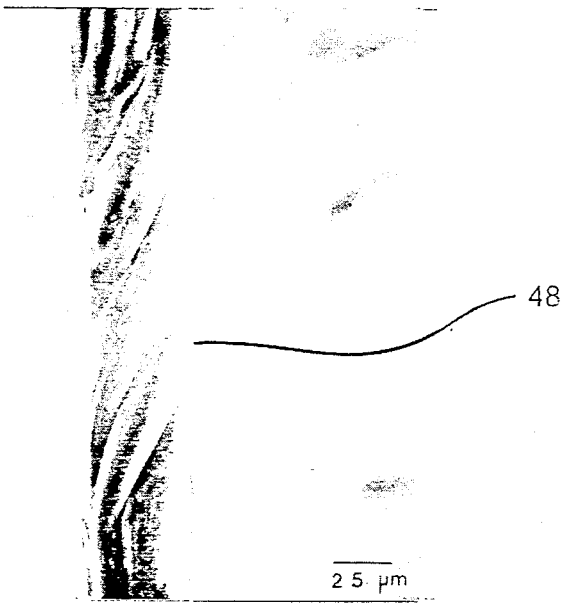

FIG. 6*a* is a photograph of a scanning electron microscope image of a slightly twisted PBO fiber 44 showing the effects of a recoil compression test failure of the fiber. FIG. 6*b* is a photograph of a scanning electron microscope image of another slightly twisted PBO fiber 46 similarly showing the effects of a recoil test compression failure of the fiber. Inspection of the failed fibers shows separation and buckling of the fibrils and microfibrils. In contrast, the scanning electron microscope photographic image of FIG. 6*c* shows a more highly twisted PBO fiber 48 that successfully withstood the same recoil compression test. These tests indicate that the fibers have to be well-formed and well-twisted for a significant improvement in compressive strength.

Fibers 42, 44, 46 and 48 were made by twisting the fibers by hand as they were hand-drawn from a spinnerette extrusion orifice. This hand-drawing limited the speed at which the fiber could be drawn and adversely affected the other physical properties of the fibers. Higher quality fibers will be made by a more automated process where more normal faster draw rates can be achieved. It will be seen by those with skill in the art of the invention that adapting this full twisting method to existing apparatus for more automated production of high performance polymeric fibers having entangled fibrils/microfibrils will be both straightforward and direct.

The disclosed method for making high compressive strength aromatic heterocyclic polymeric fibers successfully demonstrates mechanically manipulating the fibers as they are formed, before coagulation, to achieve new internal structures offering improved physical property performance characteristics. Although the disclosed method is specialized, its teachings will find application in other areas where the physical properties of final structural components can be improved by physically modifying their internal structure while they are being formed.

It will be seen by those with skill in the field of the invention that twisting of individual fibers may be achieved either by twisting the fiber as it is drawn from a single orifice spinnerette, or by twisting the spinnerette or other parts of the apparatus. Spinning apparatus using multiple hole spinnerettes may provide for twisting of each individual fiber after leaving the spinnerette or for twisting parts of the spinnerette surrounding each hole. Other modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

We claim:

1. A method for making a single polymeric fiber, comprising the steps of:

(a) providing a supply of polymer dope;

(b) drawing the dope through a single extrusion orifice into an air gap;

(c) in the air gap, full twisting by itself the single drawn dope as it is drawn form the single extrusion orifice; and, (d) after full twisting in the air gap, coagulating the drawn and twisted dope in a water bath to form a fiber.

* * * * *